US006367513B1

(12) United States Patent
Cain

(10) Patent No.: US 6,367,513 B1
(45) Date of Patent: Apr. 9, 2002

(54) POLOLEFIN SCRIMS OF WOVEN SUPERIMPOSED TAPES

(75) Inventor: Raymond William Cain, Truro (CA)

(73) Assignee: Intertape Polymer Group, Truro (CA)

( * ) Notice: Subject to any disclaimer, the term of this patent is extended or adjusted under 35 U.S.C. 154(b) by 0 days.

(21) Appl. No.: 08/982,862

(22) Filed: Dec. 2, 1997

(30) Foreign Application Priority Data

Dec. 11, 1996 (CA) ..... 2196004

(51) Int. Cl.[7] ..... B32B 5/02; D03D 15/00
(52) U.S. Cl. ..... 139/383 R; 442/185
(58) Field of Search ..... 139/383 R, 426 R, 139/383 A; 297/452.64; 442/185, 186

(56) References Cited

U.S. PATENT DOCUMENTS

| | | | | |
|---|---|---|---|---|
| 975,940 A | * | 11/1910 | Petterly | 139/408 |
| 2,260,052 A | | 10/1941 | Passavant | |
| 2,619,705 A | | 12/1952 | Foster | |
| 2,810,405 A | * | 10/1957 | Huau | 139/383 R |
| 3,503,106 A | | 3/1970 | Port et al. | |
| 3,918,501 A | * | 11/1975 | Wolstencroft | 139/116.1 |
| 3,930,091 A | * | 12/1975 | Lewis et al. | 139/420 R |
| 4,239,831 A | | 12/1980 | Pattenden | |
| 4,587,998 A | | 5/1986 | Egloff et al. | |
| 4,748,996 A | * | 6/1988 | Combier | 428/109 |
| 4,786,541 A | * | 11/1988 | Nishimura et al. | 442/246 |
| 4,854,352 A | * | 8/1989 | Combier | 442/406 |
| 4,980,227 A | | 12/1990 | Sekiguichi et al. | |
| 5,622,766 A | | 4/1997 | Rodriguez et al. | |
| 5,783,278 A | * | 7/1998 | Nishimura et al. | 139/11 |

FOREIGN PATENT DOCUMENTS

| | | | |
|---|---|---|---|
| CA | 1 174 555 | 9/1984 | |
| CA | 1332843 | 11/1994 | |
| DE | 42 11 711 | * 1/1993 | 139/383 R |

OTHER PUBLICATIONS

Selected excerpts from "A Handbook of Weaves", by G.H. Oelsner, pp. 43–45, 1952.
Selected excerpts from "Joseph's Introductory Textile Science", sixth edition, by Hudson, Clapp and Kness, p. 201, 1993.
Printed and published brochure of Fabrene Inc., entitled "Fabrene Industrial Synthetic Fabrics", Aug. 24, 1995, with sample of Fabrene Woven Polyethylene Scrim described therein.
Third Party Letter dated Feb. 26, 2001.

* cited by examiner

*Primary Examiner*—Andy Falik
(74) *Attorney, Agent, or Firm*—Roberts Abokkair & Mardula, LLC

(57) ABSTRACT

A scrim of woven polyolefin tapes comprising a plurality of warp tapes in a substantially parallel side-by-side relationship and a plurality of weft tapes in a substantially parallel side-by-side relationship. At least some of each of said warp and said weft tapes being in the form of a tape having at least one of an additional tape and a multifilament yarn superimposed thereon. Each of said tapes is a polyolefin tape. The scrim exhibits improved tear strength properties.

19 Claims, 2 Drawing Sheets

POLOLEFIN SCRIMS OF WOVEN SUPERIMPOSED TAPES

FIELD OF THE INVENTION

The present invention relates to scrims of woven polyolefin tapes having improved strength. In particular the invention relates to scrims in the form of tarpaulins, lumber covers, or in other forms, that have improved tear strength, and to a method for the manufacture of such scrims.

BACKGROUND OF THE INVENTION

Scrims are used in a variety of forms, particularly in the transportation industry. For instance, scrims in the form of tarpaulins are widely used in the transportation of goods in order to protect a load of goods on a flat-bed truck or on a rail car against the effects of rain, snow, sun or other environmental or weather situations. For instance, if the load is a stack of lumber, it is important and desirable to protect the stack of lumber from the effects of weather in order to prevent soiling, staining or other damage to the lumber. This is particularly important for finished lumber. Other uses include use as geomembranes and as covers for hoop structures, including hay stacks and temporary buildings, landfill covers, pit and pond liners, heavy duty protective covers and as other covers where tear strength is important.

Such tarpaulins and other covers are known and are typically made of a woven polyolefin fabric in the form of a scrim, especially from tapes of high density polyethylene, polypropylene or other polyolefins. Examples of lumber covers are given in U.S. Pat. No. 4,239,831 of T. W. E. Pattenden, which discloses a cover formed from woven tapes of high density polyethylene. Canadian Patent 1,332,843 of J. Finell et al. discloses a tarpaulin formed from multifilament warp yarns a combination of woven multifilament yarns and flat film yarns as weft yarns. U.S. Pat. No. 3,503,106 of M. I. Port et al. discloses material formed in a continuous process in which tapes are extruded and the edges thereof are folded back on themselves prior to the weaving of the fabric.

SUMMARY OF THE INVENTION

While tarpaulins and other covers or scrims formed of woven polyolefin tapes have performed satisfactory in a number of end-uses, it would be desirably to improve the strength of such scrims, especially the tear strength of the scrims, in order to improve the performance of the scrim in use. Such a scrim, and a method for the fabrication thereof, has now been found.

Accordingly, the present invention provides a scrim of woven polyolefin tapes comprising:

a) a plurality of warp tapes in a substantially parallel side-by-side relationship;

b) a plurality of weft tapes in a substantially parallel side-by-side relationship;

c) at least some of each of said warp and said weft tapes being in the form of a tape having at least one of an additional tape and a multifilament yarn superimposed thereon, each of said tapes being a polyolefin tape.

The present invention also provides a scrim of woven polyolefin tapes comprising:

a) a plurality of warp tapes in a substantially parallel side-by-side relationship;

b) a plurality of weft tapes in a substantially parallel side-by-side relationship;

c) each of said warp and said weft tapes being in the form of a tape having at least one of an additional tape and a multifilament yarn superimposed thereon, each of said tapes being a polyolefin tape.

The present invention further provides a method for the fabrication of a scrim of woven polyolefin tapes in which said polyolefins tapes are fed to a loom for fabrication of a scrim of warp and weft tapes in a substantially parallel side-by-side relationship, comprising feeding to said loom at least one of an additional tape or a multifilament yarn with at least some of said warp and said weft tapes, said additional tape and said multifilament yarn being superimposed on said warp and said weft tapes and being woven therewith in said loom.

The present invention also provides a method for the fabrication of a scrim of woven polyolefin tapes in which said polyolefins tapes are fed to a loom for fabrication of a scrim of warp and weft tapes in a substantially parallel side-by-side relationship, comprising feeding to said loom at least one of an additional tape or a multifilament yarn with each of said warp and said weft tapes, said additional tape and said multifilament yarn being superimposed on said warp and said weft tapes and being woven therewith in said loom.

In a preferred embodiments of the present invention, the ratio of the tear strength in the warp direction to the tear strength in the weft direction is in the range of 2:1 to 1:2, especially in the range of 1.5:1 to 1:1.5.

In other embodiments, the multifilament yarn is selected from polyethylene, polypropylene, polyamide and polyester multifilament yarn.

In further embodiments, the warp and weft tapes have tapes superimposed thereon, or alternatively have multifilament yarn superimposed thereon.

BRIEF DESCRIPTION OF THE DRAWINGS

The present invention is illustrated by the embodiments shown in the drawings in which.

The invention will be particularly described with references to woven tapes.

DETAILED DESCRIPTION OF THE INVENTION

Figure 1:
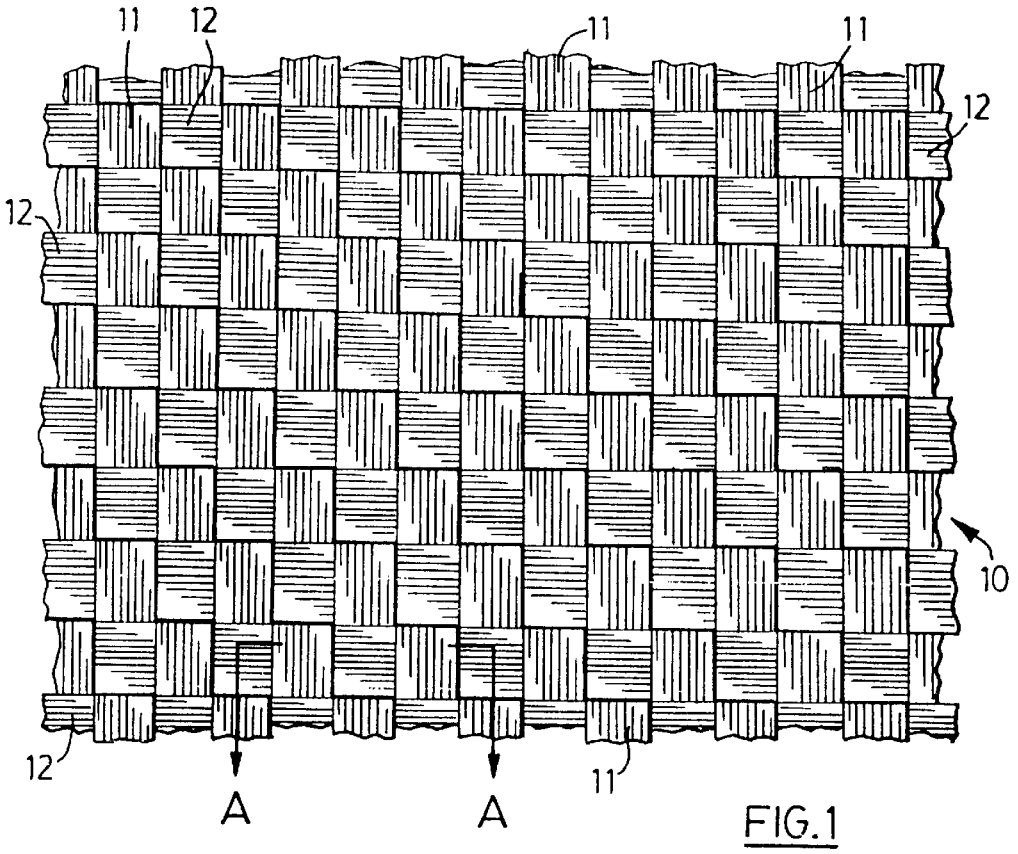
FIG. 1 is a schematic representation of a plan view of a scrim.

FIG. 1 shows a scrim, generally indicated by 10. Scrim 10 has a plurality of warp tapes, indicated by 11, interwoven with a plurality of weft tapes, indicated by 12. The warp tapes 11 are in a side-by-side relationship with each other and similarly, the weft tapes are in a side-by-side relationship. Moreover, the warp tapes are in a substantially parallel relationship with each other, and similarly the weft tapes are in a substantially parallel relationship. Scrims generally as illustrated in FIG. 1 are known, as are methods for the manufacture of such scrims.

The present invention is not apparent in FIG. 1 as illustrated but is particularly illustrated in the cross section of the scrim shown in FIG. 2, which is a cross section of FIG. 1 through A—A. In the embodiment illustrated, each warp tape is comprised of superimposed tapes. In FIG. 2, the warp tapes are generally indicated by 11A or 11B. Warp tapes 11A are those sections of the superimposed warp tapes appearing on the upper side of the scrim whereas warp tapes 11B are those sections of the tapes appearing on the under side of the scrim.

FIG. 2 also shows a weft tape, which is comprised of a plurality of upper weft tapes, 23, superimposed on a plurality of lower weft tapes, 24.

FIG. 2 illustrates the embodiment in which each of the warp and weft tapes is comprised of two superimposed tapes. However, it is to be understood that either the warp tape or the weft tape could be comprised of superimposed tapes with the other being a single tape.

In preferred embodiments, the superimposed tapes are in the form of two or three, or more, superimposed tapes, especially two superimposed tapes. It is understood that each of the superimposed tapes could be the same polyolefin tape, or different polyolefin tapes. The latter could be used to impart different properties or appearances to the opposed faces of the scrim.

Tapes used in the fabrication of scrims are known in the art, and are typically formed by slitting of sheet film. Other tapes may be profiled or fibrillated tapes, including tapes with flat, round or oval cross-sections. Examples of the latter tapes include extruded monofilament tapes.

Figure 3:
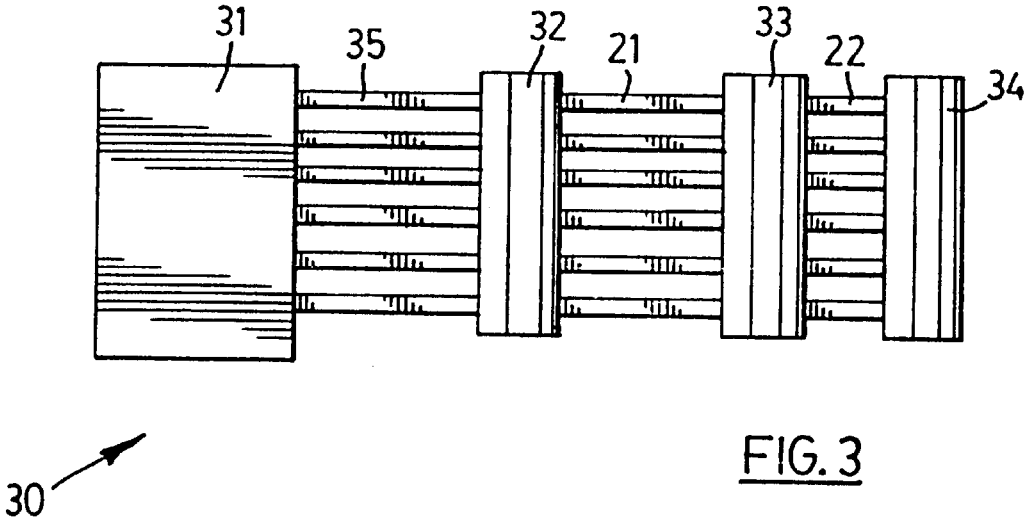
FIG. 3 is a schematic representation of a plan view of apparatus used to fabricate the scrim.

FIG. 3 shows apparatus for the fabrication of the scrim of the present invention generally indicated by 30. Apparatus 30 has a loom, generally shown by 31, guide roller 32 and feed (or beam) rolls 33 and 34. Each of feed rolls 33 and 34 is a roll of slit tape, which for clarity are shown in a spaced apart relationship in FIG. 3 but in practice would be a plurality of tapes in a side-by-side relationship. Each of feed rolls 33 and 34 feeds tape towards loom 31. As illustrated tape 21 is fed from feed roll 33 and tape 22 is fed from feed roll 34. Tapes 21 and 22 are fed partially around guide roller 32 and fed as superimposed tapes 35 into loom 31.

Although FIG. 3 shows the use of separate feed (or beam) rolls for each of the superimposed tapes, it is understood that a single feed or beam roll could be used, with the superimposed tapes wound thereon or tapes fed therefrom in a side-by-side relationship but guided such that the tapes are superimposed when entering the loom.

Figure 4:
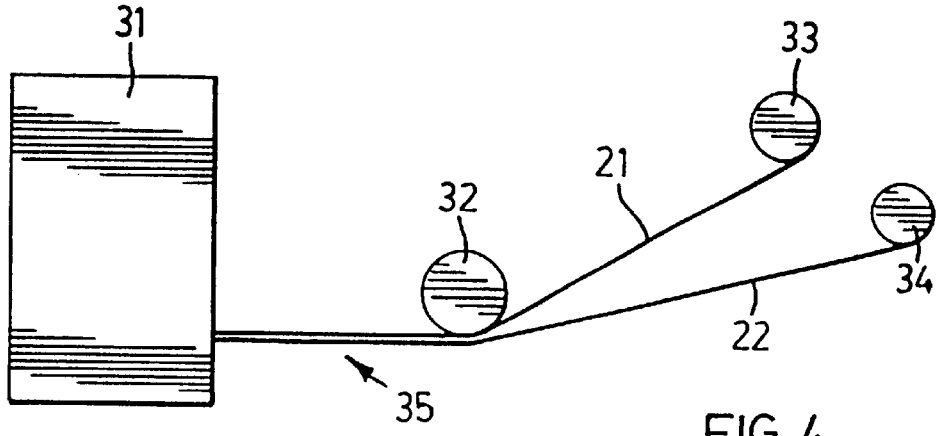
FIG. 4 is a side view of the apparatus of FIG. 3.

The method is more clearly shown in FIG. 4 which shows feed rolls 33 and 34 in a spaced apart relationship, with tapes 21 and 22 being fed therefrom, respectively, to guide roller 32. The superimposed tapes, 35, are fed from guide roller 32 to loom 31. In loom 31, the scrim is woven by techniques known to those skilled in the art.

FIGS. 3 and 4 show only the warp tapes being feed to the loom; it will be understood by persons skilled in the art that the weft tapes would also be fed to the loom. The additional weft tape or multifilament yarn fed with the weft tape could be fed, for example, by using a double pass of weft tape or by using two separate passes of weft tape and the additional weft tape or multifilament yarn, prior to alternating the harness frames in the weaving process.

The scrim of the present invention is formed from polyolefin tapes. The polyolefins tapes may be formed from polyethylene or polypropylene, with the polymers used to form the tapes containing stabilizers, e.g. antioxidants, UV and other stabilizers, pigments e.g. carbon black or other pigments, or the like that are appropriate to the intended end use for the scrim. In addition, the tapes may be coated, especially by coating the scrim after weaving in order to provide weather protection or the like, depending on the particular end use for the scrim. For instance, scrim in the form of tarpaulin or lumber covers frequently has a coating for protection, especially to prevent leakage of moisture through the scrim.

Although the invention has been particularly described herein with respect to the use of superimposed tapes, it is understood the multifilament yarn may be superimposed on said warp and weft tapes. In further alternative embodiments, one of the warp and weft tapes could have tape superimposed thereon and the other of the warp and weft tapes could have multifilament yarn superimposed thereon. It is preferred that the multifilament yarn be selected from polyethylene, polypropylene, polyamide and polyester multifilament yarn, with polyethylene terephthalate being the preferred polyester.

It is disclosed herein that some of the warp and weft tapes have additional tapes or multifilament yarn superimposed thereon. In preferred embodiments, each of the warp tapes and each of the weft tapes have additional tapes or multifilament yarn superimposed thereon.

It is preferred that the scrims have balanced tear strength properties in the warp and weft directions. In particular, it is preferred that the ratio of tear strength in the warp direction to that in the weft direction be in the range of 2:1 to 1:2, and especially in the range of 1.5:1 to 1:1.5.

The scrims of the present invention exhibit improved tear strength compared with scrims made with single tapes.

The present invention is illustrated by the following examples.

EXAMPLE I

Using commercial scale apparatus, a black scrim was woven on a loom with 16×16 tapes/inch. The tapes were 1600 denier tapes. The scrim was coated on both sides with a 2.25 mil (57 microns) coating of a low density polyethylene. Such a scrim is a known scrim, and a control for the present invention.

Using the same apparatus, a scrim was woven from the same tapes, but using superimposed tapes on all of the warp and weft tapes fed to the loom. The scrim was coated on both sides with 2.5 mil (63.5 microns) coating of the same low density polyethylene. Such scrim is a scrim of the invention.

Tensile strength (grab method) was measured by the procedure of ASTM D5034-90. Tear strength (tongue method) was measured by the procedure of ASTM D2261-83. Bursting strength (Mullen) was measured by the procedure of ASTM D3786-87.

The results obtained are given in Table I. The data presented is average data from a number of different scrims made on the loom as described above.

TABLE I

| | Control | Invention |
|---|---|---|
| Tapes | single | superimposed |
| Weight (g/m$^2$) | 315 | 340 |
| Thickness (mils) | 20 | 24 |
| Tensile Strength (lbs) | | |
| warp | 340 | 310 |
| weft | 340 | 310 |
| Tear Strength (lbs) | | |

TABLE I-continued

| | Control | Invention |
|---|---|---|
| warp | 65 | 125 |
| weft | 60 | 125 |
| Bursting Strength (psi) | 630 | 630 |

The results show that the scrim of the present invention exhibited a tear strength that was 100% higher than that of the scrim made using single (non-superimposed) tapes. The decrease in tensile strength was about 10%. Other measured properties were similar.

What is claimed is:

1. A scrim of woven tapes comprising:

a) a plurality of warp tapes in a substantially parallel side-by-side relationship;

b) a plurality of weft tapes in a substantially parallel side-by-side relationship;

c) at least some of each of said warp and said weft tapes having at least one of an additional tape and a multifilament yarn superimposed thereon, each of said tapes being a polyolefin tape.

2. The scrim of claim 1 in which the multifilament yarn is selected from the group consisting of polyethylene, polypropylene, polyamide and polyester multifilament yarn.

3. The scrim of claim 1 in which one of said warp and weft tapes has said tape superimposed thereon.

4. A scrim of claim 3 in which the tear strength in the warp and weft directions is greater than 65 lbs, when measured by the procedure of ASTM D2261-83.

5. A scrim of claim 3 in which the polyolefin tapes are polyethylene tapes.

6. A scrim of claim 5 in which the scrim is coated for protection against leakage of moisture through the scrim.

7. A scrim of claim 3 in which the polyolefin tapes are polypropylene tapes.

8. A scrim of claim 4 in which the scrim is coated for protection against leakage of moisture through the scrim.

9. Use of a scrim of claim 3 as a tarpaulin or lumber cover.

10. Use of a scrim of claim 3 as a geomembrane, cover for a hoop structure, landfill cover, pit and pond liner or heavy duty protective cover.

11. A scrim of woven tapes comprising:

a) a plurality of warp tapes in a substantially parallel side-by-side relationship;

b) a plurality of weft tapes in a substantially parallel side-by-side relationship;

c) each of said warp and said weft tapes having at least one of an additional tape and a multifilament yarn superimposed thereon, each of said tapes being a polyolefin tape.

12. The scrim of claim 11 in which the multifilament yarn is selected from the group consisting of polyethylene, polypropylene, polyamide and polyester multifilament yarn.

13. The scrim of claim 12 in which one of said warp and weft tapes has said yarn superimposed thereon.

14. The scrim of claim 3 in which said warp and weft tapes have said tape superimposed thereon.

15. The scrim of claim 12 in which said warp and weft tapes have said yarn superimposed thereon.

16. The scrim of claim 14 in which the superimposed tapes are the same as the warp and weft tapes.

17. The scrim of claim 14 in which the superimposed tapes are different from the warp and weft tapes.

18. The scrim of claim 14 in which the tapes are flat, round or oval tapes.

19. Use of a scrim of claim 11 that is coated for protection against leakage of moisture through the scrim as a tarpaulin or lumber cover.

* * * * *

UNITED STATES PATENT AND TRADEMARK OFFICE

CERTIFICATE OF CORRECTION

PATENT NO. : 6,367,513 B1 
DATED : April 9, 2002
INVENTOR(S) : Raymond William Cain It is certified that error appears in the above-identified patent and that said Letters Patent is hereby corrected as shown below:

Title page, Item [54] and Column 1, line 1,
"POLOLEFIN" should read -- POLYOLEFIN --

Figure 2A:
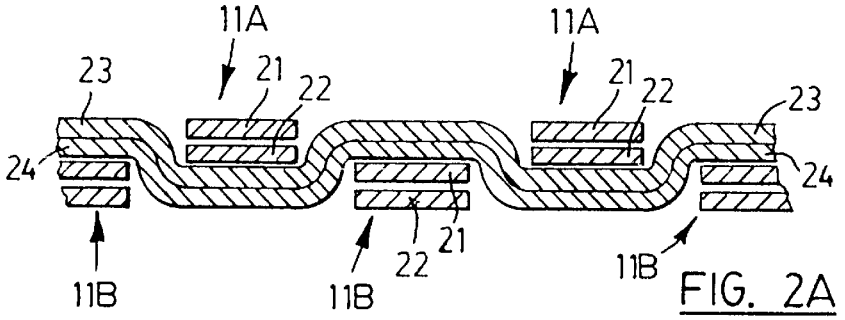
FIG. 2A is a schematic representation of a cross section of the scrim of FIG. 1 through A—A.
Figure 2B:
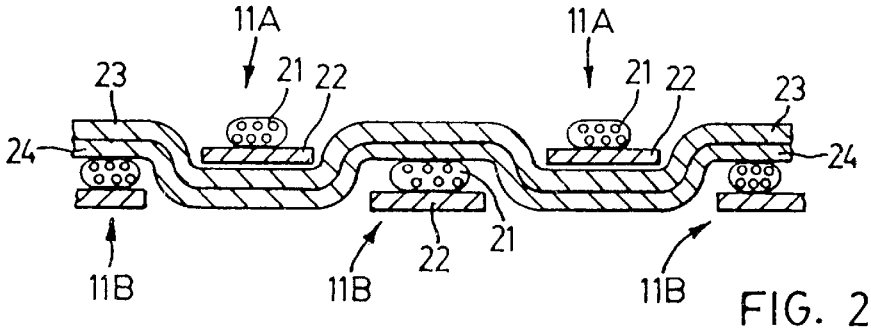
FIG. 2B is a schematic representation of a cross-section of the scrim of FIG. 1 through A—A, showing the multifilament yarn.

Column 3,
Line 1, "FIG. 2, which is" should read -- FIG. 2A and FIG. 2B, which depict --
Line 2, "embodiment" should read -- embodiments --
Line 3, "FIG. 2" should read -- FIG. 2A --
Line 4, "11B." should read -- 11B and superimposed with an additional tape. In FIG. 2B, the warp tapes are generally indicated by 11A or 11B and superimposed with a multifilament yarn. --
Line 9, "FIG. 2 also shows" should read -- FIG. 2A and FIG. 2B also show --
Line 11, after "24." the following should be inserted -- Additionally, FIG. 2A shows a tape 21 superimposed on the warp tape 22 and FIG. 2B shows a multifilament yarn 21 superimposed on said warp tape 22. --
Line 12, "FIG. 2 illustrates" should read -- FIG. 2A and FIG. 2B illustrate --
Line 14, delete the sentence "However it is to be understood that either the warp tape or the weft tape could be comprised of superimposed tapes with the other being a single tape."

Column 4,
Line 23, after "thereon." the following should be inserted -- These additional tapes or multifilament yarn are oriented in the same direction of the warp or weft tapes upon which they are superimposed. --

Column 5,
Line 16, replace claims 1 through 19 with the following claims 1 through 34:
-- 1. A scrim of woven tapes having improved tear strength comprising:
a) a plurality of warp tapes in a substantially parallel side-by-side relationship;
b) a plurality of weft tapes in a substantially parallel side-by-side relationship;
c) at least some of each of said warp and said weft tapes having at least one of an additional tape or a multifilament yarn superimposed thereon and running in the same direction on the respective warp of weft tape on which they are superimposed, each of said tapes being a polyolefin tape.

UNITED STATES PATENT AND TRADEMARK OFFICE

CERTIFICATE OF CORRECTION

PATENT NO. : 6,367,513 B1
DATED : April 9, 2002
INVENTOR(S) : Raymond William Cain It is certified that error appears in the above-identified patent and that said Letters Patent is hereby corrected as shown below:

Column 5 cont'd,

2. The scrim of claim 1 in which the multifilament yarn is selected from the group consisting of polyethylene, polypropylene, polylamide and polyester multifilament yarn.
3. A scrim of woven tapes having improved tear strength comprising:
   a) a plurality of warp tapes in a substantially parallel side-by-side relationship;
   b) a plurality of weft tapes in a substantially parallel side-by-side relationship;
   c) each of said warp and said weft tapes having at least one of an additional tape or a multifilament yarn superimposed thereon and running in the same direction on the respective warp or weft tape on which they are superimposed, each of said tapes being a polyolefin tape.
4. The scrim of claim 3 in which the multifilament yarn is selected from the group consisting of polyethylene, polypropylene, polyamide and polyester multifilament yarn.
5. The scrim of claim 1 in which one of said warp and weft tapes has said tape superimposed thereon.
6. The scrim of claim 3 in which said warp and weft tapes have said tape superimposed thereon.
7. The scrim of claim 4 in which one of said warp and weft tapes has said yarn superimposed thereon.
8. The scrim of claim 4 in which said warp and weft tapes have said yarn superimposed thereon.
9. The scrim of claim 6 in which the superimposed tapes are the same as the warp and weft tapes.
10. The scrim of claim 6 in which the superimposed tapes are different from the warp and weft tapes.
11. The scrim of claim 6 in which the tapes are flat, round or oval tapes.

CERTIFICATE OF CORRECTION

PATENT NO. : 6,367,513 B1
DATED : April 9, 2002
INVENTOR(S) : Raymond William Cain It is certified that error appears in the above-identified patent and that said Letters Patent is hereby corrected as shown below:

Column 5 cont'd,

12. A scrim of claim 5 in which the tear strength in the warp and weft directions is greater than 65 lbs, when measured by the procedure ASTM D2261-83.
13. A scrim of claim 5 in which the polyolefin tapes are polyethylene tapes.
14. A scrim of claim 5 in which the polyolefin tapes are polypropylene tapes.
15. A scrim of claim 12 in which the scrim is coated for protection against leakage of moisture through the scrim.
16. A scrim of claim 13 in which the scrim is coated for protection against leakage of moisture through the scrim.
17. Use of a scrim of claim 5 as a tarpaulin or lumber cover.
18. Use of a scrim of claim 5 as a geomembrane, cover for a hoop structure, landfill cover, pit and pond liner or heavy duty protective cover.
19. Use of a scrim of claim 3 that is coated for protection against leakage of moisture through the scrim as a tarpaulin or lumber cover.
20. The scrim of claim 3 wherein the ratio of the tear strength in the warp direction to the tear strength in the weft direction is from 2:1 to 1:2.
21. The scrim of claim 3 wherein the ratio of the tear strength in the warp direction to the tear strength in the weft direction is from 1.5:1 to 1:1.5.
22. A scrim of woven tapes having improved tear strength comprising an upper surface and a lower surface and further comprising:
    a) a plurality of warp tapes;
    b) a plurality of weft tapes;
    c) each of said warp tapes having at least one of an additional tape or an additional multifilament yarn superimposed thereon and running in the same direction on the respective warp or weft tape on which they are superimposed, each of said tapes being a polyolefin tape; and
    d) wherein the scrim is coated.

CERTIFICATE OF CORRECTION

PATENT NO. : 6,367,513 B1
DATED : April 9, 2002
INVENTOR(S) : Raymond William Cain It is certified that error appears in the above-identified patent and that said Letters Patent is hereby corrected as shown below:

Column 5 cont'd,

23. The scrim of claim 22 wherein the upper surface and the lower surface are coated.
24. The scrim of claim 22 wherein the ratio of the tear strength in the warp direction to the tear strength in the weft direction is from 2:1 to 1:2.
25. The scrim of claim 22 wherein the ratio of the tear strength in the warp direction to the tear strength in the weft direction is from 1.5:1 to 1:1.5.
26. The scrim of claim 22 wherein the polyolefin tape is selected from the group consisting of polyethylene tape and polypropylene tape.
27. The scrim of claim 22 wherein the polyolefin tape is polyethylene tape.
28. A scrim of woven tapes having improved tear strength comprising an upper surface and lower surface and further comprising:
    a) a plurality of warp tape;
    b) a plurality of weft tapes;
    c) each of said weft tapes having at least one additional tape superimposed thereon and running in the same direction on the respective weft tape on which they are superimposed, each of said tapes being a polyolefin tape;
    d) each of said warp tapes having at least one of an additional tape or an additional multifilament yarn superimposed thereon and running in the same direction on the respective warp tape on which they are superimposed, each of said and multifilament yarn being a polyolefin; and
    e) wherein the scrim is coated.
29. The scrim of claim 28 wherein the upper surface and the lower surface are coated.
30. The scrim of claim 28 wherein the polyolefin tape is selected from the group consisting of polyethylene tape and polypropylene tape.
31. The scrim of claim 28 wherein the polyolefin tape is polyethylene tape.

UNITED STATES PATENT AND TRADEMARK OFFICE

CERTIFICATE OF CORRECTION

PATENT NO. : 6,367,513 B1 
DATED : April 9, 2002
INVENTOR(S) : Raymond William Cain It is certified that error appears in the above-identified patent and that said Letters Patent is hereby corrected as shown below:

Column 5 cont'd,

32. A scrim of woven tapes having improved tear strength comprising an upper surface and a lower surface and further comprising:
    a) a plurality of warp tapes;
    b) a plurality of weft tapes;
    c) each of said weft tapes having at least one additional tape superimposed thereon and running in the same direction on the respective weft tape on which they are superimposed, each of said tapes being a polyolefin tape;
    d) each of said warp tapes having at least one of an additional tape or an additional multifilament yarn superimposed thereon and running in the same direction on the respective warp tape on which they are superimposed, each of said tapes and multifilament yarn being a polyolefin;
    e) wherein the upper surface is coated; and
    f) wherein the lower surface is coated.
33. The scrim of claim 32 wherein the polyolefin tape is selected from the group consisting of polyethylene tape and polypropylene tape.
31. The scrim of claim 32 wherein the polyolefin tape is polyethylene tape.

Signed and Sealed this

Eighteenth Day of June, 2002

*Attest:*

*Attesting Officer*

JAMES E. ROGAN
*Director of the United States Patent and Trademark Office*